United States Patent [19]

Courduvelis

[11] 4,304,646

[45] Dec. 8, 1981

[54] METHOD FOR SELECTIVE REMOVAL OF COPPER CONTAMINANTS FROM ACTIVATOR SOLUTIONS CONTAINING PALLADIUM AND TIN

[75] Inventor: Constantine I. Courduvelis, Orange, Conn.

[73] Assignee: Enthone, Incorporated, West Haven, Conn.

[21] Appl. No.: 201,334

[22] Filed: Oct. 27, 1980

[51] Int. Cl.[3] ..... C25C 1/12

[52] U.S. Cl. ..... 204/130; 204/106

[58] Field of Search ..... 204/130, 106

[56] References Cited

U.S. PATENT DOCUMENTS 556,092 3/1896 Frölich ..... 204/111

3,751,355 8/1973 Mandroian ..... 204/228

*Primary Examiner*—R. L. Andrews

*Attorney, Agent, or Firm*—DeLio and Montgomery

[57] ABSTRACT

A method is provided for selective removal of copper contaminants from aqueous activator solutions which also contain palladium and tin. It comprises placement of insoluble electrodes in the aqeuous solution and application of a low voltage, preferably ranging from between 0.05 to 5.0 volts across the electrodes, whereby metallic copper is selectively deposited upon the cathode, with palladium and tin remaining in the aqueous solutions. Typically, the soluble copper ions are present as contaminants in activator solutions utilized in various electroless metal plating processes.

8 Claims, No Drawings

METHOD FOR SELECTIVE REMOVAL OF COPPER CONTAMINANTS FROM ACTIVATOR SOLUTIONS CONTAINING PALLADIUM AND TIN

FIELD OF THE INVENTION

The invention relates to the field of electroless deposition of metals, particularly nickel and copper, which utilize activator solutions, containing palladium and tin, for preparation of the surface of the substrate to be plated. In particular, the invention pertains to treatment of such activator solutions for removal of soluble copper ions, which are contaminants most typically dragged into the activator solution from prior treatment solutions.

BACKGROUND OF THE INVENTION

In the manufacture of a printed circuit board (hereinafter referred to as a "PCB") metallic copper may be laminated to either one or usually both sides of a suitable dielectric substrate, such as epoxy/fiberglass, paper impregnated with phenolic resins, or other synthetic materials. The metallic copper is usually oxidized on the "inner" side which is laminated to the substrate using heat or pre-cure lamination techniques. The outer surface of the copper clad is exposed to subsequent treatments utilized in the manufacture of the PCB, which include immersing in a number of solutions, such as cleaners, etchants, acid dips, activator and post-activator solutions. These pre-electroless plating treatment solutions become contaminated with copper dissolved from the copper clad PCB's which are immersed in them.

Soluble copper contaminants are of particular concern with respect to the activator solutions. These solutions typically contain palladium, or palladious ions, and tin, or divalent stannous ions, in an aqueous acid solution. The activator solution is utilized in the pretreatment of the PCB substrate, in advance of contact with the desired electroless plating solution. However, the presence of soluble copper contaminants in an activator solution, which becomes evident from blue coloration in the solution, adversely affects the performance of the activator.

In commercial applications, frequent replenishment or replacement of the activator solution, which is expensive due to the palladium content, is required well before it would otherwise become exhausted. Furthermore, the presence of soluble copper contaminants is believed to catalyze air oxidation of divalent tin, which leads to decomposition of the activator solution. Finally, the presence of such copper contaminants can lead to "void plating" in holes on the PCB upon subsequent electroless metal plating.

The primary source of these soluble copper contaminants is the metallic copper clad laminated to the PCB substrate. Due to the acidic nature of several of the treatment solutions, particularly the acid dips and etchants, through which the copper clad PCB substrate is passed prior to treatment in the activator solution, metallic copper is dissolved. While this occurs in the activator solution itself, dissolved copper contaminants from these prior treatment solutions are also dragged into the activator solution as the PCB is moved from one treatment solution to the next.

Prior to the present invention, copper-contaminated activator solutions were discarded when the level of copper contaminants exceeded approximately 2,000 ppm. In addition to the expense of raw materials, particularly palladium, other disadvantages are suffered in terms of additional labor, waste treatment, and the time that the PCB manufacturing line is shut down.

The Electromotive Series indicates that the more noble metals, such as palladium, would be electrodeposited before copper. In the Electromotive Series, such as is set forth in the text, *Modern Electroplating,* by F. A. Lowenheim, page 776, 3rd ed. (1974), John Wiley & Sons, Inc., New York, N.Y., palladium has an electropotential of +0.987 volts, while copper has an electropotential of +0.337 volts.

One skilled in the art would expect palladium, being more noble, to be electrodeposited before copper. Similarly, one skilled in the art would expect tin, which has an electropotential of −0.136 volts, to deposit after, or perhaps together with, copper.

While electrodeposition techniques have been known for solution purification, and have been utilized for selective removal of metals, it has been used in instances where the more noble metals in the Electromotive Series are either electrodeposited first, or in some instances codeposited with other metals which are less noble.

With reference to U.S. Pat. No. 3,804,733, while copper has been removed from solutions also containing other metallic ions close to, or more noble than, copper in the Electromotive Series, such was not accomplished selectively, but rather by codeposition of the more noble metals including gold, silver, and platinum, which is closely related to palladium in the Electromotive Series. However, the present invention unexpectedly provides for selective removal of copper, in the presence of tin and the more noble metal palladium, which in view of the prior art knowledge would be expected to either codeposit or be deposited in the order of their ranking in the Electromotive Series.

Thus, the present invention provides a novel solution to the existing commercial need to purify, and thereby replenish, activator solutions containing palladium and tin, and does so by effecting selective removal of soluble copper contaminants.

SUMMARY OF THE INVENTION

In accordance with the invention, a method for selective removal of soluble copper contaminants from an aqueous solution also containing palladium and tin, and preferably activator solutions utilized as pre-treatments for electroless plating, has been developed. The method employs selective electrodeposition of copper from a copper-contaminated solution containing tin and palladium by application of a controlled low-level potential, preferably ranging from about 0.05 to 5.0 volts, and, most preferably, between about 0.1 to 0.5 volts, across insoluble electrodes placed in the contaminated solution.

In accordance with the invention, it is unexpectedly and advantageously possible to electrodeposit metallic copper on a quantitative basis without prior deposition, or substantial codeposition, of either palladium or tin. In addition, the method of the invention can be utilized on activator solutions which contain palladium and tin in colloidal form, without adverse effect, such as coagulation or destruction of the functionality of the activator solution, after selective removal of the copper contaminant.

It is the further object of the invention to provide a new and improved method for purifying, by selectively removing soluble copper contaminants, aqueous activator solutions of the type utilized as pre-treatments in electroless plating processes, so as to permit such activator solutions to be fully operable for re-use and/or recovery of tin and/or palladium values.

It is yet a further object of the invention to provide a method to purify activator solutions, which is economical, poses no substantial safety, waste disposal, or pollution problems, and allows such solutions to be commercially utilized over extended periods not presently possible.

Other objects and advantages of the novel and improved method of the invention will be readily apparent to those skilled in the art through study of the following description of preferred embodiments and the appended claims.

DESCRIPTION OF PREFERRED EMBODIMENTS AND BEST MODE OF CARRYING OUT THE INVENTION

The types of solutions from which, and in accordance with the invention, soluble copper in forms generally considered to be contaminants can be selectively removed, are aqueous activator solutions produced by reacting salts of tin and palladium in acid solution at elevated temperature, as described, for example, in U.S. Pat. Nos. 3,767,583, 3,672,923, or 3,011,920. For example, electroless plating activator solutions, such as Enplate Activator 443, commercially available from Enthone, Inc., of West Haven, Conn., can be advantageously treated in accordance with the invention.

While not limiting the application of the invention, the aqueous activator solutions treated in accordance with the invention are, preferably, palladium based activator or catalyst solutions used to initiate autocatalytic plating in processes for electrolessly plating copper or nickel. As will be readily apparent to one skilled in the art, the method of the invention may also be operable for the selective removal of copper contaminants from other such aqueous activator solutions which contain reacted salts of palladium and tin, regardless of their end use or specific compositional variations.

Although the amounts of tin and palladium in aqueous solutions treated in accordance with the invention are not critical, preferably tin ranges from between about 0.5 to 10 g/l, and most preferably between about 3 to 5 g/l. Palladium preferably ranges from between about 50 to 300 ppm, and most preferably ranges from between about 100 to 200 ppm.

As previously mentioned, the source of copper contamination which is selectively removed in accordance with the invention primarily results from attack upon and dissolution of metallic copper from the copper clad PCB as it is pre-treated prior to application of electrolessly plated metal. These copper contaminants either enter the activator directly, due to attack by the acid in the activator solution, or enter with the PCB workpiece from exposure to previous treatment solutions, particularly acid dips and etchants. Even when intermediate rinsing in water or the like is employed, "drag-in" of soluble copper contaminants remains a problem.

It is within the purview of the invention that the specific form of copper contaminants to be selectively removed is, preferably, in soluble form in aqueous solution. However, such copper contaminants can also exist in colloidal or other forms, depending upon the particular nature of the activator or like solution in which they are present. Preferably, the amount of copper contaminants in the solution to be treated ranges from between about 0.01 to 10.0 g/l, based upon amount of copper metal.

In accordance with the method of the invention, insoluble electrodes are placed in the contaminated activator or like solution. Preferably, platinum or graphite are used as anodes, while steel, platinum, copper, or other metals are preferred cathodes. It is possible, in some instances, to use a tin anode, which will increase the level of divalent tin in the activator solution.

A potential is placed across the electrodes, with a low voltage being applied, preferably from between about 0.05 to 5.0 volts. It is most preferred to apply between 0.1 to 0.5 volts. While it is within the purview of the invention that greater or lesser voltages can be utilized, both pose disadvantages. Excessive voltage may result in release of toxic chlorine gas, while insufficient voltage may result in a reduction in the rate of selective electrodeposition of copper to below a point which is commercially acceptable.

Within the preferred voltage ranges, a pink copper deposit will be obtained on the cathode. However, if voltage is excessive, a black deposit of amorphous tin and copper may be codeposited on the cathode.

The time for which the voltage is maintained across the electrodes depends in large measure upon the extent to which copper contaminants are to be removed from the contaminated solution. Preferably, the voltage is maintained across the electrodes until deposition of metallic copper on the cathode is substantially complete and deposition stops. However, depending upon the extent of decontamination required, it is not always necessary to maintain the voltage across the electrodes until copper deposition is completed.

Optionally, it is desirable in many instances to provide agitation to the contaminated aqueous solution to prevent electrode polarization. Also, it may be desirable to mechanically clean the electrodes from time to time, as the rate of deposition of copper decreases.

In preferred embodiments, it is contemplated that the method of the invention will be practiced by batch treatment of a copper contaminated activator solution or the like. However, it is also contemplated that the method of the invention could be applied in a continuous manner, with a portion of a working activator solution being withdrawn, treated for removal of copper contaminants, and then recycled to the working bath. It is preferable in such continuous applications to selectively remove the copper contaminants at a rate no less than the rate at which such contaminants are entering the activator solution being treated.

EXAMPLES

In order to more fully illustrate the novel and improved method of the invention, the following examples are set forth with the understanding that such are illustrative only and not limiting of the scope of the invention.

In each of the following examples, an activator solution having the following composition was prepared and utilized:

| | |
|---|---|
| $PdCl_2$ | 0.4-0.5 g/l |
| $SnCl_2$ | 10-30 g/l |

-continued

| | |
|---|---|
| HCl (conc.) | 140–170 g/l |
| Water | Balance to make one liter |

For purposes of the following experiments, the activator solution was contaminated with 1875 ppm of copper metal, yielding a molar rate of 2.15:1 to the divalent tin in the activator and 20–50:1 to the palladium in the solution.

Furthermore, in each of the examples which follow, iodometric analysis was utilized for determination of the divalent tin level in solution. The method is simple and convenient, with the only substantial limitation being that the solution to be analyzed must be free of oxidizing or reducing substances.

Iodometric Analysis for Tin

1. Pipette a 10 ml sample of solution to be analyzed into 500 ml flask.

2. Add 50 ml of 50% HCl solution (prepared by dilution of 500 ml of 37% HCl, AR Grade, to 500 ml distilled water).

3. Add 100 ml distilled water and several drops of starch indicator solution.

4. Titrate with 0.1 N $I_2$ solution to a permanent blue-black end point.

5. Calculate grams divalent tin per liter, as follows:

$SN^{++}$ = (ml $I_2$ titrated) × (Normality of $I_2$) × 11.87.

EXAMPLES 1–6

In Examples 1–5, electrodeposition of the aforementioned copper-contaminated activator was conducted at 0.2 volts to effectively deposit copper quantitatively and exclusively, without significant adverse effect in terms of chemical change or performance of such solutions. The specific operating levels and results are set forth in Table 1.

Example 6, also set forth in Table 1, was conducted at 6 volts. This is above the preferred range for voltage and demonstrates the consequences of excessive voltage. Some tin was codeposited with copper on the cathode and chlorine was generated at the anode. Even though copper removal was high, the codeposition of tin and generation of chlorine are preferably to be avoided, so as not to require tin replenishment, and also to avoid safety problems in view of the toxicity of chlorine.

As indicated in Table 1, the activator solutions were purifed of copper contamination up to 94–99%. During the electropurification process, approximately 5–15% of $Sn^{++}$ of the activator solution was lost. However, the copper recovered was 16.5 to 50 times the amount of molar equivalents of $Sn^{++}$ lost. Without being limited to any theory or explanation, it is nevertheless believed that perhaps the $Sn^{++}$ lost during electrodeposition is due to oxidation in the vicinity of the anode. Upon addition of the $Cu^{++}$ to the activator solution, an instantaneous reduction of the $Sn^{++}$ level occurs, due to oxidation. As shown in line 5 of Table 1, divalent tin lost to divalent copper was 0.002 mole/l.

In each of the Examples 1 through 6, the activator solution was successfully used in connection with electroless plating after the purification process, and was found to perform normally and remained stable upon standing for a considerable time.

TABLE 1

Selective Electrodeposition of Copper From Activator Solutions

| 1. Example No. | 1 | 2 | 3 | 4 | 5 | 6 |
|---|---|---|---|---|---|---|
| 2. $Sn^{++}$ analysis, moles/l | 0.013 | 0.013 | 0.013 | 0.013 | 0.013 | 0.013 |
| 3. $Cu^{++}$ added, moles/l | 0.03 | 0.03 | 0.03 | 0.03 | 0.03 | 0.03 |
| 4. $Cu^{++}$ added, ppm | 1,875 | 1,875 | 1,875 | 1,875 | 1,875 | 1,875 |
| 5. $Sn^{++}$ after $Cu^{++}$ added, moles/l | 0.011 | 0.011 | 0.010 | 0.0096 | 0.0096 | — |
| 6. Cu electrodeposited, moles/l[a] | 0.028 | 0.029 | 0.028 | 0.03[c] | 0.03[c] | — |
| 7. $Sn^{++}$ final, moles/l | 0.0093 | 0.0094 | 0.0093 | 0.0091 | — | 0.002 |
| 8. Anode used | Pt | Pt | Pt | graphite | graphite | Pt |
| 9. Cathode used | Pt | Pt | Pt | st. steel | st. steel | Pt |
| 10. Voltage, volts | 0.2 | 0.2 | 0.2 | 0.2 | 0.2 | 6[d] |
| 11. Current, amps | 0.1 | 0.1 | 0.1 | 0.2 | 0.01 | — |
| 12. Time of electrolysis | 1 hr. | 1 hr. | 1 hr. | 3.5 hr.[b] | 5.5 hr.[b] | 5 min. |
| 13. Percent of copper recovered | 94.0 | 96.5 | 94.0 | 99.1[c] | 99.7[c] | 99[e] |
| 14. Initial $Cu^{++}/Sn^{++}$, molar ratio | 2.15 | 2.15 | 2.15 | 2.15 | 2.15 | — |
| 15. Percent of initial $Sn^{++}$ lost during electrolysis | 15.5 | 14.5 | 7.0 | 5.0 | — | — |
| 16. Copper recovered to $Sn^{++}$ lost, molar ratio | 16.5 | 18 | 40 | 50 | — | — |

[a]Determined by weight gain
[b]Cathode cleaned mechanically 2–3 times during plating.
[c]Atomic absorption analysis showed 18 ppm and 6 ppm of Cu left in solution, which brings the estimated Cu recovery to 99.1 and 99.7%, respectively.
[d]$Cl_2$ generation observed at anode and plated tin detected with copper desposited on cathode.
[e]Determined by atomic absorption.

Although the invention has been described and illustrated in detail, it is to be understood that the novel and improved method of the invention may be altered, varied, or modified without departing from the spirit or scope of the invention as defined in the appended claims.

What is claimed is:

1. A method for selective removal of copper contaminants from aqueous activator solutions containing palladium and tin, comprising:

(a) placing insoluble electrodes in said aqueous solution, and (b) applying a voltage ranging from between about 0.05 to 5.0 volts across said electrodes, whereby metallic copper is selectively deposited on the cathode, while substantially all of said palladium and said tin remain in said aqueous solution.

2. The method of claim 1, wherein said voltage is maintained across said electrodes until deposition of metallic copper is substantially complete.

3. The method of claim 1, which further includes providing agitation to said aqueous solution while said voltage is being applied across said electrodes.

4. The method of claim 1, wherein said voltage ranges between about 0.1 to 0.5 volts.

5. The method of claim 1, wherein said aqueous solution contains from about 0.01 to 10 g/l of said copper contaminants in soluble form.

6. The method of claim 1, wherein said aqueous solution contains from about 0.5 to 10 g/l of said tin.

7. The method of claim 1, wherein said aqueous solution contains from about 50 to 300 ppm of said palladium.

8. The method of claim 1, wherein the anode is platinum, graphite, or tin and said cathode is platinum, stainless steel, or copper.

* * * * *